US005222565A

United States Patent [19]

Collinsworth

[11] Patent Number: 5,222,565

[45] Date of Patent: Jun. 29, 1993

[54] DRILL SECTION OF A DRILLING TOOL

[76] Inventor: Stephen M. Collinsworth, P.O. Box 358, Stanton, Ky. 40380

[21] Appl. No.: 869,231

[22] Filed: Apr. 14, 1992

[51] Int. Cl.[5] ..... E21B 17/02

[52] U.S. Cl. ..... 175/320; 175/325.2; 175/325.5

[58] Field of Search ..... 175/320, 325.2, 325.4, 175/408

[56] References Cited

U.S. PATENT DOCUMENTS

| | | | |
|---|---|---|---|
| 1,674,055 | 6/1928 | Nixon et al. | 175/320 |
| 1,889,867 | 12/1932 | Montgomery | 175/325.2 |
| 2,247,173 | 6/1941 | Huntsinger | 175/325.2 |
| 2,336,974 | 12/1943 | Abegg | 175/325.2 |
| 2,513,621 | 7/1950 | Boice | 175/325.2 |
| 3,265,091 | 8/1966 | Jarnett | 175/320 |
| 3,417,822 | 12/1968 | Howell | 175/320 |
| 3,724,576 | 4/1973 | Roberts | 175/320 X |
| 3,833,077 | 9/1974 | Lavallee | 175/408 X |
| 4,055,338 | 10/1977 | Dyer | 175/325.2 |
| 4,408,670 | 10/1983 | Schoeffler | 175/325.2 X |

*Primary Examiner*—Terry Lee Melius
*Assistant Examiner*—Frank S. Tsay
*Attorney, Agent, or Firm*—Frank C. Leach, Jr.

[57] ABSTRACT

A drill section includes a hollow tube having a reduced portion of a box disposed in each end. Each box is welded to the hollow tube by a circumferential weld extending around an angled portion connecting the reduced portion of the box to a portion of the box having the same outer diameter as the hollow tube. There preferably is welding of the reduced portion of the box to the hollow tube through three equally angularly spaced slots at each end of the hollow tube. A break out ring is disposed on a threaded pin of a tool joint between the box, which has a threaded recess extending inwardly from its end to receive the threaded pin to attach the tool joint to the box, and an annular surface of the tool joint. A protective sleeve on the box has an annular end surface at the same angle to its longitudinal axis as an annular end surface of a collar, which is welded to the box, and held thereagainst by the tool joint attached to the box. One tool joint has a threaded recess, and the other tool joint has a threaded pin, which extends into the threaded recess of the tool joint of the drill section above it while the threaded recess in the tool joint receives the threaded pin of the tool joint of the drill section beneath it or the threaded end of a drill bit sub.

19 Claims, 3 Drawing Sheets

DRILL SECTION OF A DRILLING TOOL

BACKGROUND OF THE INVENTION

This invention relates to a drill section of a drilling tool and, more particularly, to a drill section in which tool joints may be replaced without reducing the length of a hollow tube of the drill section.

In a drilling tool used for drilling holes in the ground in oil fields, for forming water wells, and for forming blast holes to enable disposition of explosives in the ground in the mining industry, the drilling tool is formed by a plurality of drill sections connected to each other. Each of the drill sections includes a steel hollow tube having a threaded pin joined to its upper end by a circumferential weld and a box attached to its lower end by a circumferential weld. The threaded pin has a tapered-threaded pin extending from its end while the box has a tapered threaded recess to receive the tapered threaded pin of the next lowermost of the drill sections of the drilling tool. Each of the threaded pin and the box may be deemed to be a tool joint.

The lower end of each drill section of the drilling tool receives the most wear of the two ends because of the upward movement of debris produced by cutting by the drill bit at the bottom of the drilling tool. This lower end of the drill section is the end of the drill section having the box.

When wear of the box by debris requires replacement of the box or either the box or the threaded pin breaks and must be replaced, the drill section must be removed from the remainder of the drilling tool, and both ends of the hollow tube of the drill section are then cut off. Both ends of the hollow tube are cut off because maximum benefit is obtained by alternate switching of the ends of the hollow tube of the drill section to which the box and the threaded pin are attached.

The new box would be welded to the bottom tube with its length equal to the length of the replaced box and the removed portion of the hollow tube. The new threaded pin would be welded to the bottom tube with its length equal to the length of the replaced threaded pin and the removed portion of the hollow tube. Thus, the overall length of the drill section remains the same.

A relatively long period of time is required to remove the drill section from the string of drill sections forming the drilling tool. This can result in reduced production for that specific day.

Furthermore, if the drilling tool is drilling blast holes to receive explosives as is required in the mining industry, the failure of the drill section can have an effect on the blast pattern. This is because federal law prevents explosives, which have been disposed in the blast holes, from being left overnight. Therefore, some of the blasting would have to occur one day and the remainder the next day because explosives are placed in the blast holes before all of the blast holes are completed. This could result in it being more expensive to remove the debris such as rock, for example, from the premises than if all of the blast patterns were completed.

The drill section of the present invention satisfactorily solves the foregoing problems through providing a drill section in which it is not necessary to remove both ends of the drill section from the string of drill sections. Instead, it is only necessary to remove the one end of the drill section having the worn or broken tool joint to be replaced from the remainder of the drilling tool.

Additionally, the drill section of the present invention does not require the removal of any of the length of the hollow tube of the drill section. Thus, the length of the hollow tube of the drill section of the present invention is not shortened as occurs with presently available drill sections.

SUMMARY OF THE INVENTION

The drill section of the present invention employs a box at each end of the hollow tube of the drill section with the box, which has the same outer diameter as the hollow tube of the drill section, being circumferentially welded to one of the ends of the hollow tube and being longitudinally welded at longitudinal slots in the end of the hollow tube around its circumference. Each of the boxes preferably has a removable protective sleeve mounted thereon to absorb the wear to eliminate the necessity of replacing the box. Furthermore, when a new protective sleeve is disposed on the box, it has a greater outer diameter than the hollow tube since the hollow tube wears when the initial protective sleeve wears. As a result, the new removable protective sleeve has a greater diameter than the hollow tube so as to protect the hollow tube from further wear.

A tool joint has a tapered threaded pin extending from one of its ends for disposition within a tapered threaded recess in the end of the box to attach the tool joint to the box. A break out ring is preferably disposed between each of the boxes and the attached tool joint to enable manual removal of either of the tool joints from the box to which it is attached.

The other end of one of the tool joints of the drill section has a tapered threaded pin while the other end of the other of the tool joints of the drill section has a tapered threaded recess. These are utilized for connecting the tool joints of the adjacent drill sections of the drilling tool to each other.

Each of the tool joints is retained in position on the box through the sleeve being welded to a portion of the tool joint within the sleeve. Thus, when it is necessary to replace one of the tool joints, it is only necessary to sever the sleeve above the tool joint to enable access to the break out ring. Then,. the break out ring is fractured. The tool joint may be manually turned for unthreading from the box.

The cost of twenty-five feet of a hollow tube, known as drill steel, having an outer diameter of 5½" is about $1,200. When it is necessary to replace one of the threaded pins and the box forming the tool joints of the presently available drill section, it is necessary to cut off a portion of the length of the hollow tube at each of its ends after the drill section is removed from the remainder of the drilling tool. This cost is approximately $300 for labor for removal of the drill section from the remainder of the drilling tool and for cutting the hollow tube to remove the threaded pin and the box. The replacement cost for both tool joints is $750 and the cost of welding of the two tool joints to the hollow tube is $200. Another $300 is required to again place the drill section in the string of drill sections forming the drilling tool. Because of this relatively large cost, it is more cost effective to use a new drill section and discard the drill section having the failure although there is usually very little wear on the remainder of the drill section.

To replace one of the tool joints of the present invention and this is usually all that will be required, the costs are about $50 for downtime, $375 for one new tool joint, sleeve, and break out ring, and $12.50 for welding the sleeve to the tool joint. Accordingly, a substantial cost saving is achieved with the drill section of the present invention.

An object of this invention is to form a drill section of a drilling tool with a longer life than presently available drill sections.

Another object of this invention is to provide a drill section of a drilling tool in which either of its tool joints may be easily removed from the remainder of the drill section.

A further object of this invention is to provide a drill section of a drilling tool in which only one end of the drill section has to be disconnected from the remainder of the drilling tool when only one of the tool joints needs to be replaced.

Yet another object of this invention is to provide a drill section that can be reversed by unscrewing and switching the tool joints.

Still another object of this invention is to provide a drill section of a drilling tool having a removable protective sleeve on each box to which a tool joint is attached.

A still further object of this invention is to provide a drill section of a drilling tool having each tool joint capable of manual removal.

Other objects of this invention will be readily perceived from the following description, claims, and drawings.

BRIEF DESCRIPTION OF THE DRAWING

The attached drawings illustrate a preferred embodiment of the invention, in which.

DESCRIPTION OF THE PREFERRED EMBODIMENT

Figure 1:
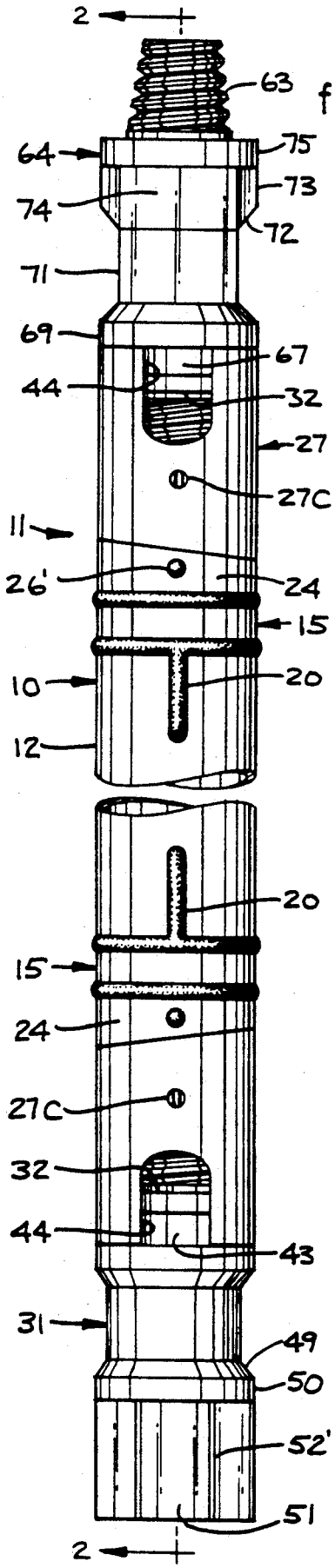
FIG. 1 is an elevational view of a drill section of the present invention.

Referring to the drawings and particularly FIG. 1, there is shown a drill section 10 of a drilling tool 11 for drilling a hole in the ground. The drilling tool 11 includes one or more of the drill sections 10 with the lowermost of the drill sections 10, if there is more than one, having a drill bit sub (not shown) attached thereto with a drill bit connected at the lower end of the drill bit sub. A suitable example of the drill bit sub is shown in my U.S. Pat. No. 5,058,689.

The drilling tool 11 has hydraulic drive means on the ground at the upper end of the drilling tool 11 for rotating the drill bit sub in the well-known manner. Pressurized air or drilling fluid is supplied from a pressurized air source (not shown) or pump (not shown) on the ground through communicating longitudinal or axial passages in the drill sections 10 of the drilling tool 11 and through a longitudinal or axial passage extending through the drill bit sub.

The drill section 10 includes a hollow tube 12, which preferably has a length of 258.1". The hollow tube 12 is formed of a suitable drill steel. Suitable examples of the drill steel are steels having a Rockwell hardness of 3018 or 4145. When the hollow tube 12 has an outer diameter of 5.5", its inner diameter is 4.25".

Each end of the hollow tube 12 has a first reduced cylindrical portion 14 (see FIG. 3) of a box 15 disposed therein by a press fit and fixed thereto by welding. The box 15 has a first angled portion 16 connecting the first reduced cylindrical portion 14 to a larger intermediate portion 17 of the same diameter as the hollow tube 12 (see FIG. 1). The angled portion 16 (see FIG. 3) extends longitudinally or axially for ½" with the first reduced cylindrical portion 14, which has a diameter of 4.250", extending for 3.5" and the larger intermediate portion 17 extending axially for 1". The first reduced cylindrical portion 14 has an end angled portion 18 extending axially for ½" to an end face 19 of the box 15 having a diameter of 4".

Each end of the hollow tube 12 (see FIG. 1) has three slots 20 (one shown) equally angularly spaced from each other about the circumference of the hollow tube 12. Each of the slots 20 extends longitudinally or axially for 3" from the end of the hollow tube 12 and has a width of 0.5".

The slots 20 enable welding of the first reduced cylindrical portion 14 (see FIG. 3) of the box 15 to the hollow tube 12 (see FIG. 1). A circumferential weld not only joins the three welds in the three slots 20 in the hollow tube 12 but also joins the first angled portion 16 (see FIG. 3) of the box 15 to the hollow tube 12 (see FIG. 1).

The box 15 (see FIG. 3) has a second reduced cylindrical portion 21, which has a larger diameter than the first reduced cylindrical portion 14, extending axially 8" from an end surface 22 of a second angled portion 23, which extends from the larger intermediate portion 17 for ½". The second reduced cylindrical portion 21 has a diameter of 4.45". The end face 22 of the second angled portion 23 has a diameter of 5".

Figure 9:
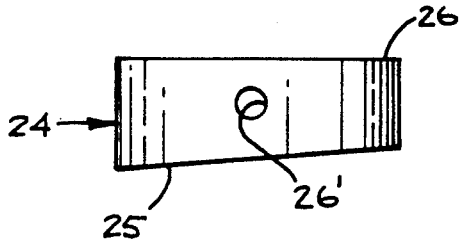
FIG. 9 is a side elevational view of a collar used to retain a sleeve on a box.

A collar 24 (see FIG. 9) is slidably received on the second reduced cylindrical portion 21 (see FIG. 3) of the box 15. The collar 24 (see FIG. 9) has an annular end surface 25 formed at an angle to the longitudinal axis of the collar 24. The annular end surface 25 of the collar 24 is preferably at an angle of 85° to the longitudinal axis of the collar 24 or 5° to the horizontal but can be in a range from 87° to the longitudinal axis of the collar 24 to almost the longitudinal axis of the collar 24. The collar 24 has a minimum axial length of 1.7" and a maximum axial length of 2.2". The collar 24 has an outer diameter of 5.5" and an inner diameter of 4.5".

The collar 24 is secured to the box 15 (see FIG. 3) through having an annular end surface 26 (see FIG. 9) welded to the end face 22 (see FIG. 3) of the box 15. The collar 24 (see FIG. 9) has three equally angularly spaced holes 26' of 1" diameter with each of the holes 26' having its center disposed 1" from the annular end surface 26 to enable welding of the collar 24 to the second reduced cylindrical portion 21 (see FIG. 3) of the box 15.

Figure 2:
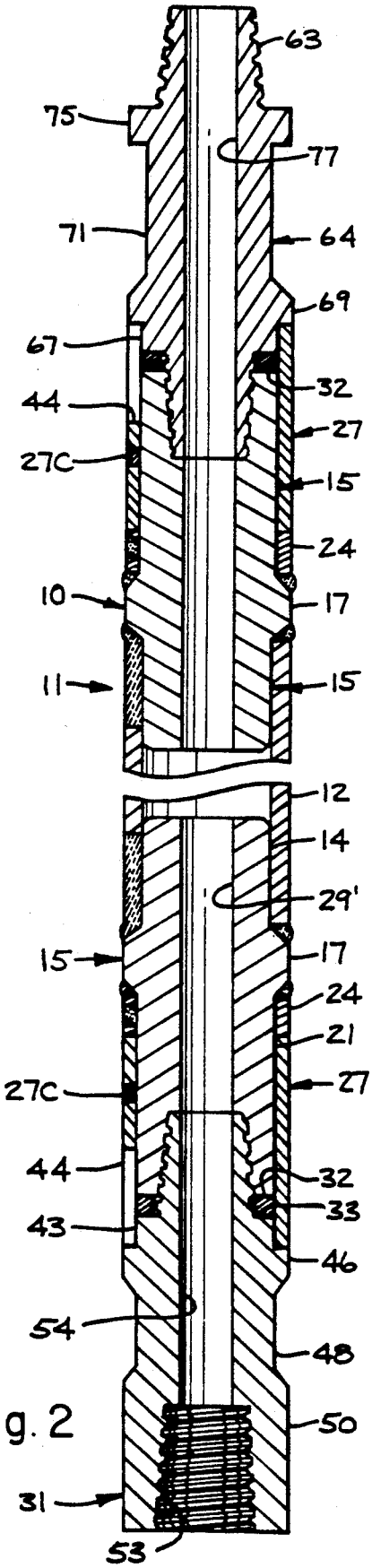
FIG. 2 is a longitudinal sectional view of the drill section of FIG. 1 and taken along line 2—2 of FIG. 1.

A protective sleeve 27 (see FIG. 2) is slidably received on the second reduced cylindrical portion 21 of the box 15. The protective sleeve 27, which is a hollow steel tube, has an outer diameter of 5.5" and an inner diameter of 4.5" so that it may be easily disposed over the second reduced cylindrical portion 21 of the box 15. The protective sleeve 27 is preferably formed of steel having a Rockwell hardness of 1018.

Figure 7:
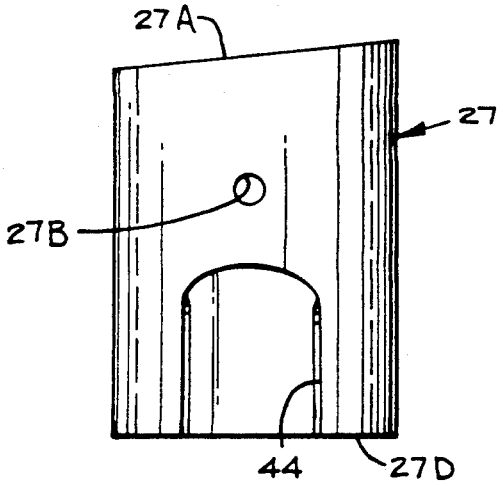
FIG. 7 is an elevational view of a sleeve mounted on the box of FIG. 3.

As shown in FIG. 7, the sleeve 27 has an annular end surface 27A formed at the same angle to the longitudinal axis of the sleeve 27 as the angle of the annular end surface 25 (see FIG. 9) of the collar 24 to the longitudinal axis of the collar 24. The sleeve 27 (see FIG. 7) has a tapped hole 27B of ½" diameter to receive a set screw 27C (see FIG. 1) to hold the sleeve 27 in its desired relationship to the collar 24 on the second reduced cylindrical portion 21 (see FIG. 3) of the box 15.

The sleeve 27 (see FIG. 7) has a minimum axial length of 7.5" and a maximum axial length of 8". The center of the hole 27B is located 4.75" from an annular end surface 27D of the sleeve 27.

The second reduced cylindrical portion 21 (see FIG. 3) of the box 15 has a tapered threaded recess 28 extending inwardly from its end face 29 and communicating with a longitudinal axial passage 29' extending through the box 15 from the end face 19. The passage 29' has a diameter of 1⅞". The tapered threaded recess 28 in the box 15 receives a tapered threaded pin 30 (see FIG. 4) of a lower tool joint 31.

The threaded recess 28 (see FIG. 3) in the box 15 has a minimum diameter of 2.875" and a maximum diameter of 3.5". The threaded recess 28 extends inwardly 3.75" from the end face 29 of the box 15. The threaded pin 30 (see FIG. 4) extends axially for 3.75". The threaded pin 30 has a minimum diameter of 2.875" and a maximum diameter of 3.5".

Prior to threading the threaded pin 30 of the lower tool joint 31 into the threaded recess 28 (see FIG. 3) in the box 15, a break out ring 32 (see FIG. 5) is positioned on the threaded pin 30 (see FIG. 4) of the lower tool joint 31 so that the break out ring 32 (see FIG. 5) rests against an annular end surface 33 (see FIG. 4) of the lower tool joint 31. The annular end surface 33 has an outer diameter of 4.45" and an inner diameter of 3.5", and the break out ring 32 (see FIG. 5) has an inner diameter of 3.55" and an outer diameter of 4.4". Thus, the break out ring 32 fits over the tapered threaded pin 30 (see FIG. 4) of the lower tool joint 31 and rests against the annular end surface 33.

Figure 5:
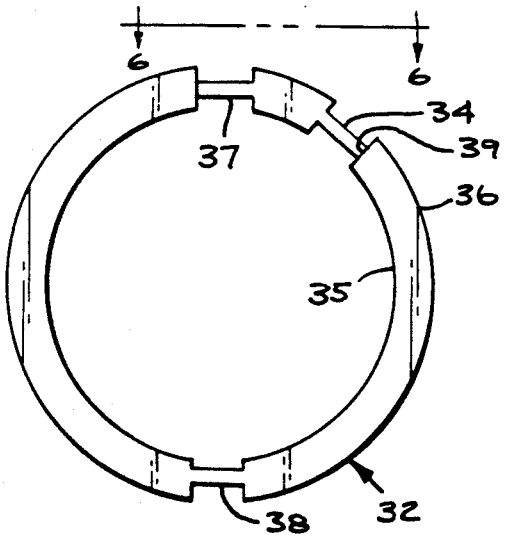
FIG. 5 is a plan view of a break out ring of the drill section of the present invention.

As shown in FIG. 5, the break out ring 32, which extends for 0.7", has a first weakened portion 34 formed by removing 0.25" from its inner surface 35 and 0.375" from its outer surface 36. The first weakened portion 34 extends for an arcuate distance of 0.5625".

The break out ring 32 has two diametrically disposed weakened portions 37 and formed therein. Each of the weakened portions 37 and 38 is formed by removing 0.25" from the inner surface 35 of the break out ring 32 for an arcuate distance of 0.5625" and 0.375" from the outer surface 36 of the break out ring 32 for an arcuate distance of 0.5625". Since the break out ring 32 has a thickness of 0.725" between the inner surface 35 and the outer surface 36, each of the weakened portions 34, 37, and 38 has a thickness of 0.1".

Figure 6:
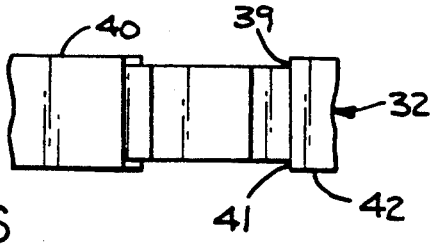
FIG. 6 is a side elevational view of the exterior of a portion of the break out ring of FIG. 5 and taken along line 6—6 of FIG. 5.

As shown in FIG. 6, the break out ring 32 has a slot 39 formed in its upper surface 40 and a slot 41 formed in its lower surface 42. Each of the slots 39 and 41 extends for an arcuate distance of 2.125" between the remote ends of the weakened portions 34 (see FIG. 5) and 37. Each of the slots 39 (see FIG. 6) and 41 extends for a distance of 0.05" from the upper surface 40 and the lower surface 42, respectively, of the break out ring 32.

After the tapered threaded pin 30 (see FIG. 4) is threaded into the tapered threaded recess 28 (see FIG. 3) in the box 15, the lower tool joint 31 (see FIG. 4) is fixed to the sleeve 27 (see FIG. 7) by a circular portion 43 (see FIG. 4) of the lower tool joint 31 being welded to the sleeve 27 (see FIG. 7). The sleeve 27 extends 1.7" beyond the end face 29 (see FIG. 3) of the box 15 to overlap the break out ring 32 (see FIG. 2) and the portion 43, which extends axially for 1", of the lower tool joint 31.

Figure 8:
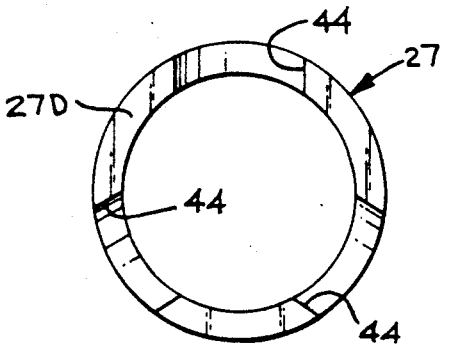
FIG. 8 is a bottom plan view of the sleeve of FIG. 7.

The annular end surface 27D (see FIG. 8) of the sleeve 27 has three equally angularly spaced slots 44 extending inwardly therefrom. The slots 44 enable welding of the circular portion 43 (see FIG. 4) of the lower tool joint 31 at six areas (two sides of each of the slots 44 (see FIG. 7) of the sleeve 27.

Each of the slots 44 has a width of 2.5" and extends upwardly from the annular end surface 27D of the sleeve 27 for 3.25". Each of the slots 44 has an axial distance of 2" and a radius of curvature at its end of 1.25".

The portion 43 (see FIG. 4) of the lower tool joint 31 is connected by a flat annular portion 45 of the lower tool joint 31 to a circular portion 46. The portion 46 extends axially for 1.5" and has an outer diameter of 5.5".

A first angled portion 47, which extends axially for 0.5", of the lower tool joint 31, connects the portion 46 of the lower tool joint 31 to a reduced portion 48, which has an outer diameter of 4.5", extending longitudinally from the first angled portion 47 for 3". A second angled portion 49, which extends longitudinally for 0.5", connects the reduced portion 48 to a bottom portion 50.

Figure 4:
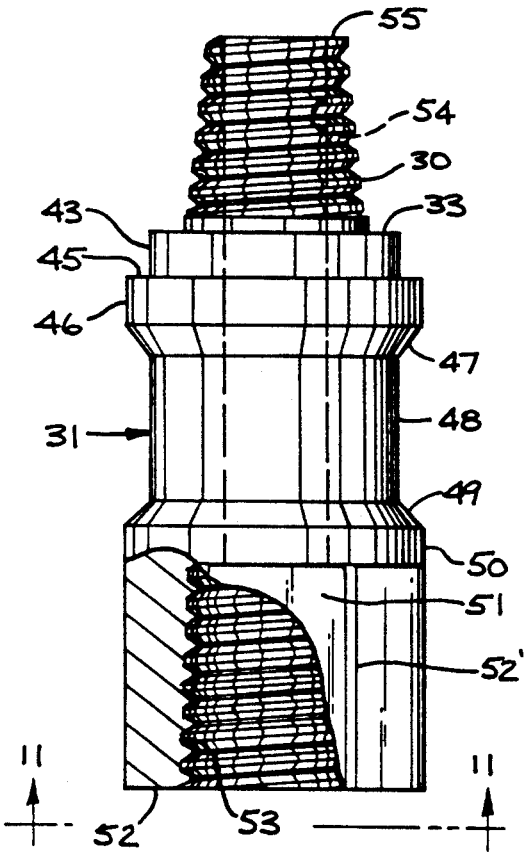
FIG. 4 is an elevational view, partly in section, of a lower tool joint of the drill section of FIG. 1.
Figure 11:
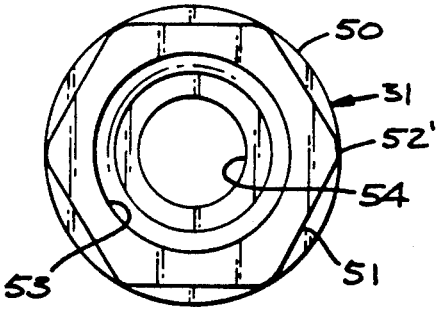
FIG. 11 is an end elevational view of the lower tool joint of FIG. 4 and taken along line 11—11 of FIG. 4.

The bottom portion 50 of the lower tool joint 31 has six equally angularly spaced flats 51 (see FIG. 11) around its outer surface extending for 4.5" from its end face 52 (see FIG. 4). The flats 51 are joined to each other by a slight curved or arcuate portion 52, (see FIG. 11) with the curved portions 52, having a radius of curvature of 2.75". Thus, the flats 51 on the bottom portion 50 are within a circle having a diameter of 5.5".

The bottom portion 50 (see FIG. 4), which extends for 5" so that the overall length of the lower tool joint 31 from the annular end surface 33 to the end face 52 is 11", has a tapered threaded recess 53 extending inwardly from the end face 52 for a distance of 4.5". The recess 53 has a maximum diameter of 3.5" and a minimum diameter of 3.25".

The lower tool joint 31 has a longitudinal or axial passage 54, which has a diameter of 1⅞", extending from its end face 55, which has a diameter of 2.875", to the threaded recess 53. When the lower tool joint 31 is connected to the box 15 (see FIG. 3), the passage 54 (see FIG. 4) communicates with the longitudinal passage 29' (see FIG. 3) in the box 15.

Figure 10:
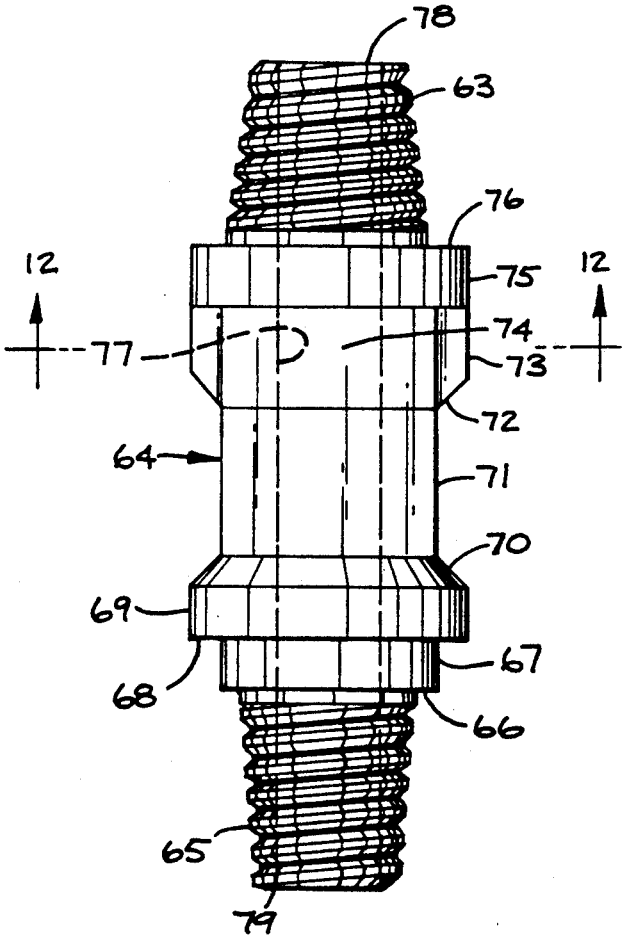
FIG. 10 is an elevational view of an upper tool joint of the drill section of FIG. 1.

When the drill section 10 (see FIG. 1) is the lowermost drill section of the drilling tool 11, the recess 53 (see FIG. 4) in the lower tool joint 31 receives a threaded tapered pin (not shown) on the upper end of the drill bit sub, which has the drill bit attached to its bottom end. When the drill section 10 (see FIG. 1) is not the lowermost drill section of the drilling tool 11, the recess 53 (see FIG. 4) in the outer tool joint 31 receives a tapered threaded pin 63 (see FIG. 10) of an upper tool joint 64.

The upper tool joint 64 is secured to another of the boxes 15 (see FIG. 3) at the upper end of the hollow tube 12 (see FIG. 1). The upper box 15 (see FIG. 3) is welded to the upper end of the hollow tube 12 (see FIG. 1) in the same manner as described for attaching the lower box 15 to the lower end of the hollow tube 12.

The upper tool joint 64 (see FIG. 10) has a tapered threaded pin 65 disposed within the tapered threaded recess 28 (see FIG. 3) in the box 15. The tapered threaded pin 65 (see FIG. 10) of the upper tool joint 64 extends longitudinally 3.75" from an annular end surface 66 of the upper tool joint 64. The annular end surface 66 has an outer diameter of 4.45" and an inner diameter of 3.5". Thus, one of the break out rings 32 (see FIG. 5) fits over the tapered threaded pin 65 (see FIG. 10) of the upper tool joint 64 and rests against the annular end surface 66 of the upper tool joint 64.

After the tapered threaded pin 65 is threaded into the tapered threaded recess 28 (see FIG. 3) in the box 15, the upper tool joint 64 (see FIG. 10) is fixed to the sleeve 27 (see FIG. 7) by a circular portion 67 (see FIG. 10), which extends axially for 1", of the upper tool joint 64 being welded to the sleeve 27 (see FIG. 7). This is in the same manner as previously described for welding the circular portion 43 (see FIG. 2) of the lower tool joint 31 to the sleeve 27.

The circular portion 67 (see FIG. 10) of the upper tool joint 64 is connected by a flat annular surface 68 to a circular portion 69. The circular portion 69 extends axially for 1" and has an outer diameter of 5.5".

The upper tool joint 64 has a first angled portion 70, which extends longitudinally for 0.5", connecting the circular portion 69 of the upper tool joint 64 to a reduced portion 71. The reduced portion 71, which has as an outer diameter of 4.5", extends longitudinally for 3".

Figure 12:
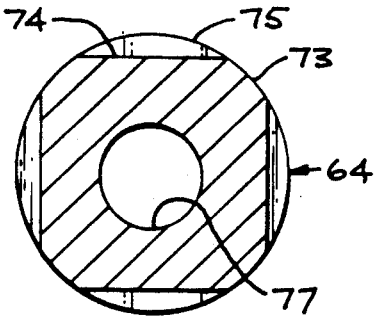
FIG. 12 is a sectional view of the upper tool joint of FIG. 10 and taken along line 12—12 of FIG. 10.

A second angled portion 72, which extends longitudinally for 0.5", connects the reduced portion 71 to a portion 73 having four equally angularly spaced flats 74 (see FIG. 12) on its outer surface to receive four equally angularly spaced flats on a wrench of a hydraulic device. The four flats 74 are connected by curved or arcuate portions having a radius of curvature of 2.75" and forming the remainder of the outer surface of the portion 73.

The portion 73 (see FIG. 10) extends longitudinally 2.5" to an upper portion 75, which has an outer diameter of 5.5" and extends for 1" longitudinally. The upper portion 75 has the tapered threaded pin 63 extending longitudinally 3.625" from its end face 76.

The upper tool joint 64 has a longitudinal or axial passage 77, which has a diameter of $1\frac{7}{8}$", extending therethrough from its end face 78 to its end face 79. The end face 78 has a diameter of 3.079", and the end face 79 has a diameter of 2.875".

During operation, the drilling tool 11 (see FIG. 1) is rotated by a hydraulic drive mechanism, which cannot only rotate the drilling tool 11 in either direction but also raise and lower the drilling tool 11 with or without rotation, having a threaded recess to receive the tapered threaded pin 63 of the upper tool joint 64 of the uppermost of the drill sections 10 of the drilling tool 11. When the upper tool joint 64 is to be removed from the drill section 10, the drilling tool 11 must be raised from the hole that it is drilling and another hole drilled until the lower tool joint 31 on the drill section 10, which has the upper tool joint 64 that is to be removed, is at a desired distance above the ground. This enables the remainder of the drilling tool 11 beneath the drill section 10 having the upper tool joint 64, which is to be replaced, to rest in the new drill hole.

With the lower tool joint 31 at the desired distance above the ground, the drilling tool 11 is raised without rotation by the hydraulic drive mechanism until three of the four flats 74 on the portion 73 of the upper tool joint 64, which is to be replaced, can be grasped by a wrench of a hydraulic device. The wrench of the hydraulic device has three flats spaced the same as the four flats 74 with an opening between two of the three flats to enable the wrench to be positioned around the reduced portion 71 of the upper tool joint 64 of the drill section 10 beneath the portion 73. Then, the drilling tool 11 is lowered by the hydraulic drive mechanism without rotation until three of the four flats 74 on the portion 73 of the upper tool joint 64, which is to be replaced, on the drill section 10 are engaged by the corresponding three flats on the wrench of the hydraulic device.

This gripping by the wrench prevents rotation of the upper tool joint 64, which is to be replaced, by the hydraulic drive mechanism. As a result, the hydraulic drive mechanism for the drilling tool 11 can disconnect the drill section 10 above the upper tool joint 64, which is to be replaced, if one of the drill sections 10 is connected thereto by the hydraulic drive mechanism rotating the drill section 10 connected thereto without raising or lowering the drill section 10. If the drill section 10 having the upper tool joint 64 to be replaced is the uppermost of the drill sections 10 of the drilling tool 11, the hydraulic drive mechanism can be disconnected from the tapered threaded pin 63 of the upper tool joint 64, which is to be replaced, by the hydraulic drive mechanism rotating its connection to the tapered threaded pin 63 of the upper tool joint 64, which is to be replaced and is held by the wrench, without raising or lowering the drill section 10.

After disconnection of the upper tool joint 64, the sleeve 27 (see FIG. 7) is cut above the break out ring 32 (see FIG. 5) and beneath the arcuate ends of the slots 44 (see FIG. 7) to produce three cut portions of the sleeve 27, which are heated to break the weld between the three cut portions of the sleeve 27 and the portion 67 (see FIG. 10) of the upper tool joint 64. After removal of the three cut portions of the sleeve 27 (see FIG. 7), the break out ring 32 (see FIG. 5) then has one or more of the weakened portions 34, 37, and 38 fractured by a tool so that the break out ring 32 can be removed.

Figure 3:
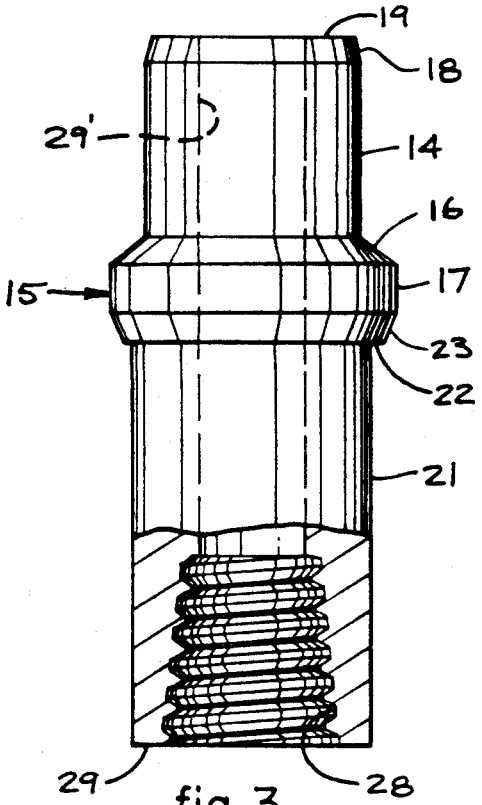
FIG. 3 is an elevational view, partly in section, of a box of the drill section of FIG. 1.

After removal of the break out ring 32, the upper tool joint 64 (see FIG. 10) is manually removed from the box 15 (see FIG. 3). Then, the sleeve 27 (see FIG. 7) is removed manually after unscrewing the set screw 27C (see FIG. 1).

Another of the sleeves 27 is then disposed on the second reduced cylindrical portion 21 (see FIG. 3) of the box 15 and retained in position on the box 15 by the set screw 27C (see FIG. 1) being disposed in the tapped hole 27B (see FIG. 7) in the sleeve 27 to engage the second reduced cylindrical portion 21 (see FIG. 3) of the box 15. Next, another of the upper tool joints 64 (see FIG. 1), which has another of the break out rings 32 disposed on the tapered threaded pin 65 (see FIG. 10), is attached to the box 15 (see FIG. 3) by the tapered threaded pin 65 (see FIG. 10) of the new upper tool joint 64 being manually rotated into the threaded recess 28 (see FIG. 3) in the box 15.

Then, the tapered threaded pin 63 (see FIG. 10) of the new upper tool joint 64 is again connected to the hydraulic drive mechanism, either directly if the upper tool joint 64 is on the uppermost of the drill sections 10 (see FIG. 1) or to the lower tool joint 31 of the drill section 10 above the new upper tool joint 64. Rotation of the drilling tool 11 by the hydraulic drive mechanism to advance the drilling tool 11 into the ground to continue forming the hole further tightens the tapered threaded pin 65 (see FIG. 10) of the new upper tool joint 64 in the threaded recess 28 (see FIG. 3) in the box 15.

Upon completion of drilling of the hole, the drilling tool 11 (see FIG. 1) is lifted sufficiently out of the hole by the hydraulic drive mechanism without rotation. The portion 67 (see FIG. 10) of the upper tool joint 64 is then welded to the sleeve 27 (see FIG. 7).

When the lower tool joint 31 (see FIG. 1) of one of the drill sections 10 of the drill tool 11 is to be removed from the box 15 (see FIG. 3), the lower tool joint 31 (see FIG. 1) is disconnected from the upper tool joint 64 of the drill section 10 therebeneath or from the drill bit sub (not shown) if the lower tool joint 31 is on the lowermost of the drill sections 10. The lower tool joint 31 is disconnected through either the upper tool joint 64 of the drill section 10 therebeneath or the drill bit sub (not shown) having the three flats of the wrench of the hydraulic device positioned around the reduced portion 71 (see FIG. 10) of the upper tool joint 64 of the drill section 10 or the corresponding structure on the drill bit sub (not shown). Then, the drilling tool 11 (see FIG. 1) is lowered by the hydraulic drive mechanism without rotation until three of the four flats 74 (see FIG. 12) on the portion 73 of the upper tool joint 64 or three of the corresponding four flats on the drill bit sub (not shown) are engaged by the corresponding three flats on the wrench of the hydraulic device.

When the wrench of the hydraulic device engages three of the four flats 74 on the portion 73 of the upper tool joint 64 or three of the four flats on the drill bit sub (not shown), the hydraulic drive mechanism for the drilling tool 11 (see FIG. 1) rotates the drill section 10 having the lower tool joint 31, which is to be replaced, along with any of the drill sections 10 thereabove. This rotation disconnects the lower tool joint 31 from the upper tool joint 64 of the drill section 10 therebeneath or from the drill bit sub (not shown) if the lower tool joint 31 is on the lowermost of the drill sections 10.

After disconnection of the lower tool joint 31, which is to be replaced, from either the drill section 10 therebeneath or the drill bit sub (not shown), the sleeve 27 is cut and the three cut portions heated to break the weld with the portion 43 (see FIG. 4) of the lower tool joint 31, as previously described, to provide access to the break out ring 32 (see FIG. 2) after removal of the three cut portions of the sleeve 27. The break out ring 32 is then fractured and removed in the manner previously described. Then, the lower tool joint 31 is manually removed from the box 15. After the lower tool joint 31 is manually removed from the box 15, the remainder of the sleeve 27 is manually removed in the manner previously described.

After the sleeve 27 is removed manually from the box 15 and another of the sleeves 27 is disposed on the second reduced cylindrical portion 21 (see FIG. 3) of the box 15 and secured to the box 15 in the manner previously described, the new lower tool joint 31 (see FIG. 4) is attached to the box 15 (see FIG. 3) by manually rotating the tapered threaded pin 30 (see FIG. 4) of the new lower tool joint 31 into the tapered threaded recess 28 (see FIG. 3) in the box 15.

Next, the tapered threaded recess 53 (see FIG. 4) of the new lower tool joint 31 receives the tapered threaded pin 63 (see FIG. 1) of the upper tool joint 64 of the drill section 10 beneath the replaced lower tool joint 31 or the corresponding structure on the drill bit sub (not shown) if the drill section 10 having the new lower tool joint 31 is the lowermost of the drill sections 10 of the drilling tool 11. The hydraulic drive mechanism then rotates the drill section 10 having the new lower tool joint 31 and all of the drill sections 10 thereabove.

After the new lower tool joint 31 is connected by the hydraulic drive mechanism to either the upper tool joint 64 of the drill section 10 therebeneath or the drill bit sub (not shown), the three flats on the wrench of the hydraulic device are removed from engagement with three of the four flats 74 on the portion 73 of the upper tool joint 64 or three of the corresponding four flats on the drill bit sub (not shown). This is accomplished through the hydraulic drive mechanism raising the drilling tool 11 without rotation until the wrench is at the reduced portion 71 of the upper tool joint 64 of the drill section 10 beneath the new lower tool joint 31 or the corresponding structure on the drill bit sub (not shown). This enables removal of the wrench.

Next, the drilling tool 11 is rotated by the hydraulic drive mechanism to advance the drilling tool 11 into the ground to complete formation of the hole. This rotation further tightens the new lower tool joint 31. Upon completion of drilling of the hole, the drilling tool 11 is lifted out of the hole. The portion 43 (see FIG. 4) of the new tool joint 31 is then welded to the sleeve 27 (see FIG. 2) in the manner previously described.

When the drill section 10 is to be disconnected from either the hydraulic drive mechanism or from the drill section 10 thereabove, the six flats 51 (see FIG. 11) on the bottom portion 50 of the lower tool joint 31 are engaged by six equally angularly spaced flats on an inner surface of a cup, which is positioned beneath the lower tool joint 31 by a hydraulic lazy susan device of the hydraulic drive mechanism. In either situation, the six flats on the cup cannot engage the six flats 51 on the bottom portion 50 until the drill section 10 (see FIG. 1) is disconnected from the drill section 10 therebeneath or the drill bit sub (not shown) if the drill section 10 is the lowermost of the drill sections 10 of the drilling tool 11. This disconnection of the drill section 10 from the drill section 10 therebeneath or the drill bit sub (not shown) is accomplished through the wrench of the hydraulic device having the three flats engage either three of the four flats 74 (see FIG. 12) on the portion 73 of the upper tool joint 64 of the drill section 10 (see FIG. 1) beneath the drill section 10 to be removed or three of the corresponding four flats on the drill bit sub (not shown) in the manner previously described.

It should be understood that the various dimensions and Rockwell hardnesses of the parts of the drill section 10 are only examples These would vary depending on what the customer wanted and the environment in which the drill section 10 is used.

One suitable example of the hydraulic drive mechanism is a head drive sold by Ingersoll-Rand, Garland, Tex. as part No. IR-45-4630.

An advantage of this invention is that it extends the life of a drill section of a drilling tool. Another advantage of this invention is that the cost for replacing a broken or worn part of a drilling tool is substantially reduced.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

I claim:

1. A drill section of a drilling tool including:
a hollow tube of a selected length;
said hollow tube having a box disposed in each of its ends and attached thereto;
each of said boxes including:
a threaded recess at its end remote from said hollow tube;
and a longitudinal passage extending through said box into said threaded recess to provide communication between said threaded recess and the interior of said hollow tube;
two tool joints:
each of said tool joints having a threaded pin at one end disposed in said threaded recess in said box to connect said tool joint to said box;
each of said tool joints having a longitudinal passage extending therethrough and communicating with said longitudinal passage in said box when said tool joint is connected to said box;
fixed attaching means for fixedly attaching each of said tool joints to one of said boxes;
and enabling means for enabling manual removal of each of said tool joints from said box when said fixed attaching means is rendered ineffective.

2. The drill section according to claim 1 in which:
each of said fixed attaching means includes:
slidably mounted means slidably mounted on said box and retained on said box;
said tool joint connected to said box having a portion overlapped by said slidably mounted means, said overlapped portion of said tool joint having a smaller diameter than the outer diameter of said hollow tube;
and said slidably mounted means and said overlapped portion of said tool joint being fixed to each other;
and each of said enabling means includes:
a break out ring mounted on said tool joint, said break out ring engaging said box and being overlapped by said slidably mounted means when said tool joint is fixedly attached to said box;
and said break out ring having at least one weakened portion to enable fracturing thereof after said slidably mounted means and said overlapped portion of said tool joint are separated to render said fixed attaching means ineffective whereby removal of said break out ring enables manual removal of said tool joint from said box by unthreading said threaded pin of said tool joint from said threaded recess in said box.

3. The drill section according to claim 2 in which each of said boxes includes:
a first longitudinal portion disposed within said hollow tube and fixed thereto;
a second longitudinal portion exterior of said hollow tube when said first longitudinal portion is disposed within said hollow tube;
and said second longitudinal portion having said threaded recess at its end remote from said first longitudinal portion.

4. The drill section according to claim 3 including:
a first angled portion extending between said first and second longitudinal portions, said first angled portion being fixed to said hollow tube;
and said second longitudinal portion of said box including:
a large portion extending from said first angled portion and having the outer diameter of said hollow tube;
a reduced portion having a smaller diameter than said large portion of said second longitudinal portion;
and a second angled portion extending between said large portion of said second longitudinal portion and said reduced portion of said second longitudinal portion.

5. The drill section according to claim 4 in which said slidably mounted means includes:
a sleeve slidably disposed on said reduced portion of said second longitudinal portion;
and retaining means for retaining said sleeve on said reduced portion of said second longitudinal portion of said box.

6. The drill section according to claim 5 in which:
said sleeve has a plurality of equally angularly spaced slots extending longitudinally from its end remote from said first longitudinal portion of said box;
said tool joint has another portion abutting the remote end of said sleeve when said overlapped portion of said tool joint is disposed within said sleeve;
and said tool joint has said overlapped portion disposed within said sleeve welded to said sleeve at portions of said sleeve having said equally angularly spaced slots.

7. The drill section according to claim 5 in which said retaining means includes:
a collar secured to said box;
said collar having an annular end surface formed at an angle to its longitudinal axis;
and said sleeve having an annular surface on one of its ends formed at the same angle to its longitudinal axis as said annular end surface of said collar for engagement with said annular end surface of said collar and held thereagainst when said sleeve is mounted on said reduced portion of said second longitudinal portion of said box and said tool joint is connected to said box to prevent said sleeve from rotating relative to said box.

8. The drill section according to claim 2 in which each of said break out rings includes:
inner and outer circular surfaces;
first, second, and third weakened portions capable of being fractured;
each of said first, second, and third weakened portions being formed by removing material from each of said inner and outer circular surfaces;
said second and third weakened portions being disposed substantially diametrically from each other;

and said second weakened portion being circumferentially spaced from said first weakened portion a distance less than said third weakened portion.

9. The drill section according to claim 1 in which each of said boxes includes:

a first longitudinal portion disposed within said hollow tube and fixed thereto;

a second longitudinal portion exterior of said hollow tube when said first longitudinal portion is disposed within said hollow tube;

and said second longitudinal portion having said threaded recess at its end remote from said first longitudinal portion.

10. The drill section according to claim 9 including:

a first angled portion extending between said first and second longitudinal portions, said first angled portion being fixed to said hollow tube;

and said second longitudinal portion of said box including:

a large portion extending from said first angled portion and having the outer diameter of said hollow tube;

a reduced portion having a smaller diameter than said large portion of said second longitudinal portion;

and a second angled portion extending between said large portion of said second longitudinal portion and said reduced portion of said second longitudinal portion.

11. The drill section according to claim 10 in which said slidably mounted means includes:

a sleeve slidably disposed on said reduced portion of said second longitudinal portion of said box;

and retaining means for retaining said sleeve on said reduced portion of said second longitudinal portion of said box.

12. The drill section according to claim 11 in which said retaining means includes:

a collar secured to said box;

said collar having an annular end surface formed at an angle to its longitudinal axis;

and said sleeve having an annular surface on one of its ends formed at the same angle to its longitudinal axis as said annular end surface of said collar for engagement with said annular end surface of said collar and held thereagainst when said sleeve is mounted on said reduced portion of said second longitudinal portion of said box and said tool joint is connected to said box to prevent said sleeve from rotating relative to said box.

13. A drill section of a drilling tool including:

a hollow tube of a selected length;

said hollow tube having a plurality of spaced slots of a selected length extending longitudinally from each of its end surfaces;

said hollow tube having a box disposed in each of its ends;

each of said boxes including:

a first longitudinal portion disposed within said hollow tube;

a second longitudinal portion being of larger diameter than said first longitudinal portion;

a first angled portion extending between said first and second longitudinal portions;

said second longitudinal portion having a threaded recess at its end;

and a longitudinal passage extending through said first longitudinal portion, said first angled portion, and said second longitudinal portion into said threaded recess to provide communication between said threaded recess and the interior of said hollow tube;

each of said boxes being attached to said hollow tube through welding between said first angled portion of said box and the adjacent end of said hollow tube and between said first longitudinal portion of said box and the portions of said hollow tube defining each of said slots in said hollow tube;

two tool joints;

each of said tool joints having a threaded pin at one end disposed in said threaded recess of said box to connect said tool joint to said box;

each of said tool joints having a longitudinal passage extending therethrough and communicating with said longitudinal passage in said box when said tool joint is connected to said box;

and fixed attaching means for fixedly attaching each of said tool joints to one of said boxes.

14. The drill section according to claim 13 including:

said second longitudinal portion of said box including:

a large portion extending from said first angled portion and having the outer diameter of said hollow tube;

a reduced portion having a smaller diameter than said large portion of said second longitudinal portion;

and a second angled portion extending between said large portion of said second longitudinal portion and said reduced portion of said second longitudinal portion;

a sleeve slidably disposed on said reduced portion of said second longitudinal portion;

retaining means for retaining said sleeve on said reduced portion of said second longitudinal portion;

said tool joint having a portion abutting an end of said sleeve remote from said first longitudinal portion of said box when said tool joint is connected to said box;

and said fixed attaching means including said tool joint having a portion disposed within said sleeve and fixed to said sleeve when said abutting portion of said tool joint abuts the end of said sleeve remote from said first longitudinal portion of said box.

15. The drill section according to claim 14 in which said retaining means includes:

a collar secured to said box;

said collar having an annular end surface formed at an angle to its longitudinal axis;

and said sleeve having an annular surface on one of its ends formed at the same angle to its longitudinal axis as said annular end surface of said collar for engagement with said annular end surface of said collar and held thereagainst when said sleeve is mounted on said reduced portion of said second longitudinal portion of said box and said tool joint is connected to said box to prevent said sleeve from rotating relative to said box.

16. The drill section according to claim 15 in which:

said collar includes a plurality of holes to receive welding material for welding said collar to said reduced portion of said second longitudinal portion of said box;

and said collar is welded to said second angled portion of box.

17. The drill section according to claim 14 including:

a break out ring disposed between each of said boxes and said tool joint fixedly attached to said box, each of said break out rings being supported on said tool joint and overlapped by said sleeve when said tool joint is fixedly attached to said box;

each of said break out rings having an outer diameter less than the outer diameter of said hollow tube;

and each of said break out rings having at least one weakened portion to enable fracturing thereof.

18. The drill section according to claim 17 in which each of said break out rings includes:

inner and outer circular surfaces;

first, second, and third weakened portions capable of being fractured;

each of said first, second, and third weakened portions being formed by removing material from each of said inner and outer circular surfaces;

said second and third weakened portions being disposed substantially diametrically from each other;

and said second weakened portion being circumferentially spaced from said first weakened portion a distance less than said third weakened portion.

19. The drill section according to claim 13 including:

said second longitudinal portion of said box including:

a large portion extending from said first angled portion and having the outer diameter of said hollow tube;

a reduced portion having a smaller diameter than said large portion of said second longitudinal portion;

and a second angled portion extending between said large portion of said second longitudinal portion and said reduced portion of said second longitudinal portion;

a sleeve slidably disposed on said reduced portion of said second longitudinal portion;

retaining means for retaining said sleeve on said reduced portion of said second longitudinal portion;

said tool joint having a portion abutting an end of said sleeve remote from said first longitudinal portion of said box when said tool joint is connected to said box;

and said fixed attaching means including:

a plurality of equally angularly spaced slots in said sleeve extending longitudinally from the other end of said sleeve for a selected length;

said tool joint having a portion disposed within said sleeve when said abutting portion of said tool joint abuts the remote end of said sleeve;

and said tool joint having said portion disposed within said sleeve welded to said sleeve at portions of said sleeve having said equally angularly spaced slots.

* * * * *

UNITED STATES PATENT AND TRADEMARK OFFICE

CERTIFICATE OF CORRECTION

PATENT NO. : 5,222,565

DATED : June 29, 1993

INVENTOR(S) : Stephen M. Collinsworth

It is certified that error appears in the above-identified patent and that said Letters Patent is hereby corrected as shown below:

Column 2, lines 40 to 42 should read as follows:

--- tool joint within the sleeve. Thus, when it is necessary to replace one of the tool joints, it is only necessary to sever the sleeve ---.

Column 5, line 62, after "and" insert --- 38 ---.

Column 6, line 48, "52" should read --- 52' ---.

Column 6, line 49, "52" should read --- 52' ---.

Column 10, line 66, after "examples" insert a --- period (.) ---.

Column 11, line 28, the "colon (:) should be a --- semi-colon (;) ---.

Column 13, line 52, the "colon (:) should be a --- semi-colon (;)---.

UNITED STATES PATENT AND TRADEMARK OFFICE

CERTIFICATE OF CORRECTION

PATENT NO. : 5,222,565

DATED : June 29, 1993

INVENTOR(S) : Stephen M. Collinsworth

It is certified that error appears in the above-identified patent and that said Letters Patent is hereby corrected as shown below:

Column 13, line 67 through Column 14, line 21, should read as follows:

--- and a longitudinal passage extending through said first longitudinal portion, said first angled portion, and said second longitudinal portion into said threaded recess to provide communication between said threaded recess and the interior of said hollow tube;

each of said boxes being attached to said hollow tube through welding between said first angled portion of said box and the adjacent end of said hollow tube and between said first longitudinal portion of said box and the portions of said hollow tube defining each of said slots in said hollow tube;

two tool joints;

UNITED STATES PATENT AND TRADEMARK OFFICE

CERTIFICATE OF CORRECTION

PATENT NO. : 5,222,565

DATED : June 29, 1993

INVENTOR(S) : Stephen M. Collinsworth

It is certified that error appears in the above-identified patent and that said Letters Patent is hereby corrected as shown below:

each of said tool joints having a threaded pin at one end disposed in said threaded recess of said box to connect said tool joint to said box;

each of said tool joints having a longitudinal passage extending therethrough and communicating with said longitudinal pasaage in said box when said tool joint is connected to said box;

UNITED STATES PATENT AND TRADEMARK OFFICE

CERTIFICATE OF CORRECTION

PATENT NO. : 5,222,565

DATED : June 29, 1993

INVENTOR(S) : Stephen M. Collinsworth

It is certified that error appears in the above-indentified patent and that said Letters Patent is hereby corrected as shown below:

and fixed attaching means for fixed attaching each of said tool joints to one of said boxes.

Signed and Sealed this

Eighth Day of February, 1994

Bruce Lehman

*Attest:*

BRUCE LEHMAN

*Attesting Officer*

*Commissioner of Patents and Trademarks*